United States Patent [19]

Gaiser et al.

[11] 4,314,651

[45] Feb. 9, 1982

[54] FLEXIBLE PLASTIC CLOSURE MECHANISM AND CONTAINER

[75] Inventors: William R. Gaiser; E. Bryant Crutchfield, both of Dayton; Harold D. Bartley, Springfield, all of Ohio

[73] Assignee: The Mead Corporation, Dayton, Ohio

[21] Appl. No.: 202,850

[22] Filed: Oct. 31, 1980

[51] Int. Cl.[3] ..... B65D 45/16

[52] U.S. Cl. ..... 220/326; 220/339; 220/210

[58] Field of Search ..... 220/326, 318, 306, 339, 220/210; 150/5; 229/43

[56] References Cited

U.S. PATENT DOCUMENTS

| | | | |
|---|---|---|---|
| 3,923,152 | 12/1975 | Minneman | 220/339 X |
| 3,966,076 | 6/1976 | Kroger et al. | 220/339 X |
| 4,079,880 | 3/1978 | Edwards | 220/339 X |

*Primary Examiner*—George T. Hall

*Attorney, Agent, or Firm*—Biebel, French & Nauman

[57] ABSTRACT

A one-piece plastic closure mechanism is provided which incorporates two flexible living hinge sections so that the leaves of the closure mechanism can pivot through the angles required for locking and unlocking a container cover from a container base. The closure mechanism may be attached to the base by screws, staples, or the like or may be integrally molded with the container to eliminate any post-molding assembly steps. One leaf of the closure mechanism contains a slot which engages a protrusion such as a tab on the container cover to lock the cover and base when the mechanism is closed. The container is designed so that individual containers are nestable for shipment, storage, and display. The interior of the container cover is provided with a clip for holding a writing implement and with a series of vertically upstanding ridges so that documents can be viewed in an upright position when the container is open.

10 Claims, 9 Drawing Figures

FLEXIBLE PLASTIC CLOSURE MECHANISM AND CONTAINER

CROSS REFERENCE TO RELATED APPLICATIONS

This application is related to U.S. design application Ser. No. 202,857, entitled "Document File", and to U.S. design application Ser. No. 202,849, entitled "Document File", both filed concurrently herewith and both assigned to the assignee of the present invention.

BACKGROUND OF THE INVENTION

The present invention relates to a unitary plastic closure mechanism for securing a container cover to a base, and more particularly to a plastic closure mechanism incorporating a living hinge construction which is integrally molded with a plastic container.

The increased use of molded plastic containers for various purposes, including use as card, letter, and document files, has led to the need for a simple, inexpensive, and reliable construction to close and lock such containers. Previous closure mechanisms have included multipiece constructions of metal, plastic, or a combination of the two. Many of these prior mechanisms required a number of assembly steps as well as the step of fastening the closure mechanism to the container.

However, all of the prior art constructions have had one or more drawbacks. Multipiece closure mechanisms required individual manufacturing operations for each component part as well as expensive and time consuming assembly operations. Moreover, when separate fastening means such as screws or pins were required, not only was an extra assembly step required, but also the stresses associated with operation of the mechanism tended to cause cracking or breakage of the plastic containers at the fastening points.

Accordingly, the need exists in the art for a reliable closure mechanism which is inexpensive to manufacture and requires no separate assembly operations.

SUMMARY OF THE INVENTION

The present invention meets that need by providing a one-piece plastic closure mechanism integrally molded with a plastic container. The plastic closure mechanism incorporates two flexible living hinge sections so that the leaves of the closure mechanism can pivot through the angles required for locking and unlocking the container. The closure mechanism and container can be fabricated of polypropylene or other thermoplastic materials having good flexibility and tensile strength.

The closure mechanism typically has a generally rectangular shaped first leaf having a longitudinally extending slot across the top edge thereof although the leaf may be constructed to have other shapes such as an oval, oblong, or circular shape if desired. The slot is adapted to engage a protruding tab on the cover of the container when the mechanism is in a closed position. The lower edge of the first leaf is flared outwardly to form a convenient means for the hand of a user to grip and manupulate the mechanism.

A second generally rectangular-shaped leaf of the closure mechanism is connected to the first leaf by a flexible living hinge section along a line near the lower edge of the first leaf. The living hinge section comprises a web of material having an area of reduced thickness located axially along a line in which the two leaves can be pivoted. Because of the flexibility, tensile strength, and resistance to fatigue of the hinge material, the living hinge can be flexed repeatedly in use.

A third hinge leaf, which also may be generally rectangularly shaped, is connected to the second leaf by another flexible living hinge section located axially along the edge of the second leaf opposite the first leaf so that the two living hinge sections are generally parallel to one another. The third leaf is adapted to be secured to the wall of a container by staples, screws, adhesive, or the like. In a preferred embodiment of the invention, the third leaf is integrally molded into a container wall and forms an area of increased cross-section to strengthen and stiffen the container at the point where the closure mechanism is located.

In operation, the cover of a container is closed and the closure mechanism is lifted so that the slot in the first hinge leaf engages a protruding tab on the container cover. A downward force is then applied to the first leaf causing it to lock into a closed position. The second leaf section is sized so that the application of a downward force on the first leaf section creates a camming action pulling the slot on the first leaf downwardly into a tight engagement with the protruding tab on the container cover and locking the mechanism into a closed position. The mechanism is opened by the application of an upward force on the lower edge of the first leaf section and disengagement of the slot in the leaf from the tab on the container cover.

Because of the unitary structure of the closure mechanism and its construction using living hinge sections, the hinge is inexpensive to manufacture, requiring no assembly operations. In a preferred embodiment of the invention, the closure mechanism is integrally molded with a container thus eliminating the need for any post-molding assembly steps. In a further embodiment of the invention, the container is designed to have a wide opening cover which provides easy access to documents and the like filed in the container. The interior of the cover may be designed to include a clip for holding a writing implement such as a pencil pen or the like, and may also have a plurality of vertically upstanding ridges extending lengthwise which act as easel bases to support documents in an upright position which have been removed from the container for viewing. The covers and containers may be designed to be nestable for saving space during shipment storage, and display. A locking device may also be included in the closure mechanism.

Accordingly, it is an object of the invention to provide a reliable closure mechanism which is simple and inexpensive to manufacture and requires no separate assembly operations. This and other objects and advantages of the invention will become apparent from the following description, the accompanying drawings, and the appended claims.

DESCRIPTION OF THE PREFERRED EMBODIMENTS

Figure 1:
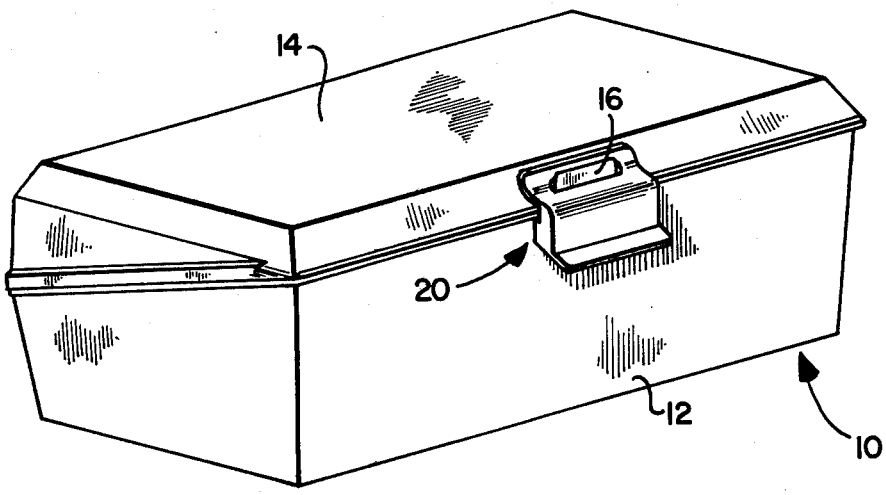
FIG. 1 is a perspective view of the closure mechanism of the present invention in a closed position on a container and cover.
Figure 2:
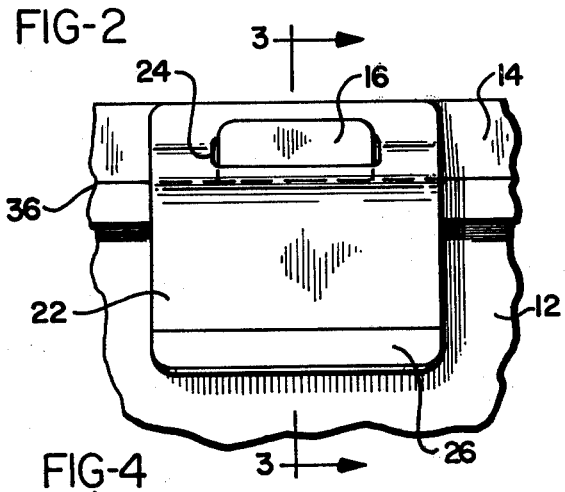
FIG. 2 is a front elevational view of the closure mechanism of the present invention.
Figure 3:
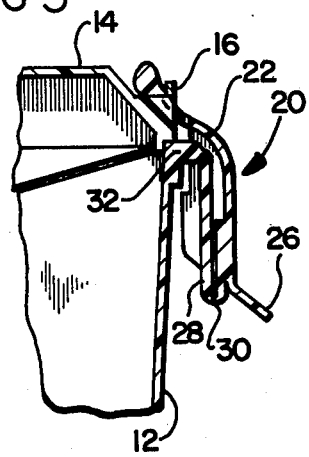
FIG. 3 is a sectional view of the closure mechanism in a closed position taken along line 3—3 of FIG. 2.

Referring to FIG. 1, a plastic container 10 is illustrated having a base 12, a cover 14 having a protruding tab 16, and an integral molded closure mechanism generally indicated as 20 shown in a closed position. While container 10 is illustrated as having a generally rectangular cross-section, it is to be understood that the closure mechanism of the present invention can be adapted to be used on a variety of differently shaped containers. More than one closure mechanism can be utilized to close and lock a container depending on the size and shape of the container. The closure mechanism is preferably fabricated of polypropylene or other high tensile strength material which is resistant to fatigue.

As best illustrated in FIGS. 2–5, closure mechanism 20 has a first leaf 22 having a longitudinally extending slot 24 along the top edge thereof. Leaf 22 is illustrated as having a generally rectangular shape but may be modified to assume other shapes if desired. Slot 24 is adapted to engage protruding tab 16 on the cover 14 of container 10 to lock cover 14 into a closed position. The lower edge of leaf 22 has an outwardly flared portion 26 which forms a convenient means for the hand of a user to grip and manipulate the closure mechanism.

A second generally rectangular-shaped leaf 28 is connected to first leaf 22 by a flexible living hinge 30 which forms a web having an area of reduced cross-section along a line near the lower edge of first leaf 22. Because of the flexibility, tensile strength, and resistance to fatigue of the hinge material, the living hinge can be flexed repeatedly in use.

A third leaf 32, which may also be generally rectangularly shaped, is connected to second leaf 28 by a second living hinge section 34 along the opposite edge of the second leaf from first living hinge 30. The two living hinge sections are generally parallel to one another and parallel to the upper front edge 36 of container base 12. Leaf 32 is shown as being integrally molded with front edge 36. This eliminates any assembly steps for the structure. Alternatively, leaf 32 can be attached to the upper edge of a container base by suitable means such as staples, screws, adhesives, or the like.

Figure 4:
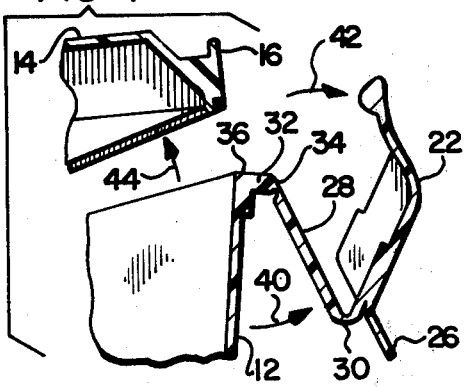
FIG. 4 is a sectional view of the closure mechanism in an open position.
Figure 5:
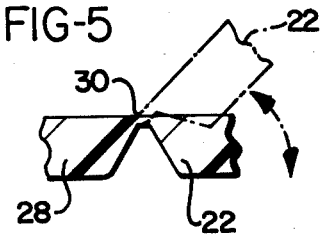
FIG. 5 is an enlarged sectional view illustrating the living hinge portion of the closure mechanism of the present invention.

The operation of the closure mechanism is best illustrated in FIG. 4. The mechanism is opened by the user lifting upwardly and outwardly on flared portion 26 in the direction indicated by arrow 40. This movement frees tab 16 from slot 24, and the first leaf 22 pivots away from the container in the direction shown by arrow 42. Cover 14 is then free to be lifted by the user as indicated by arrow 44. To close and lock the container, the procedure is reversed so that the slot 24 is brought into engagement with protruding tab 16 on container cover 14. A downward and inward force is applied on flared portion 26 of leaf 22 causing leaf 22 to lock into a closed position. Leaf 28 is sized so that the application of a downward force on leaf 22 creates a camming action pulling slot 24 downwardly into a tight engagement with tab 16.

Because of the unitary structure of the closure mechanism and its construction using living hinge sections, the entire structure may be molded using a single operation which eliminates the need for any post-molding assembly steps. Preferably, the structure is injection molded by flowing a hot plastic such as polypropylene into a heated female mold section having recesses corresponding to the cover, base, and hinge sections of the structure. A chilled male mold is then pressed into position to form a unitary structure with the base and cover being connected by a flexible living hinge section and the closure mechanism being connected to the upper edge of the container base by a living hinge section.

Figure 6:
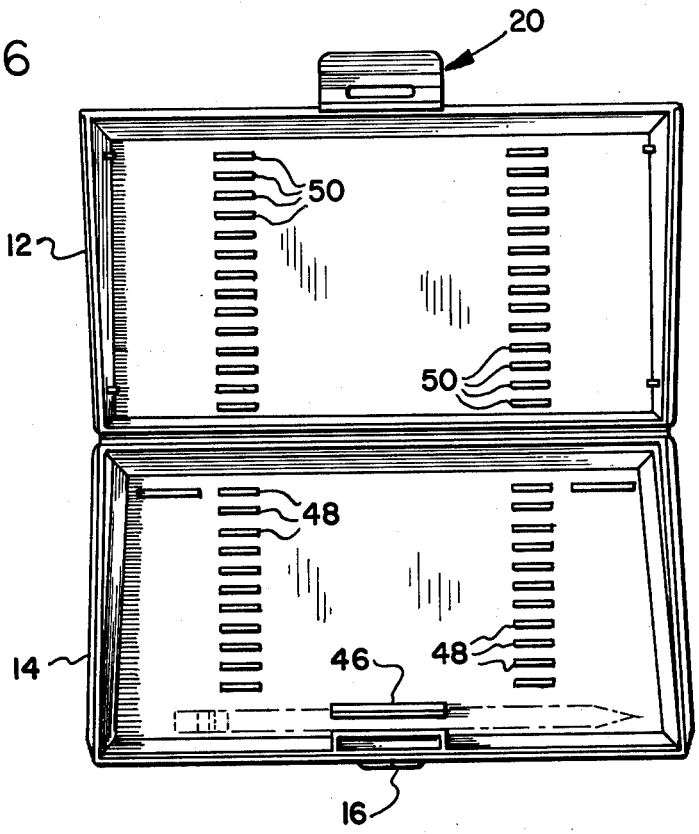
FIG. 6 is a top elevational view of an open container and cover, illustrating the clip and easel base ridges on the interior of the cover.
Figure 7:
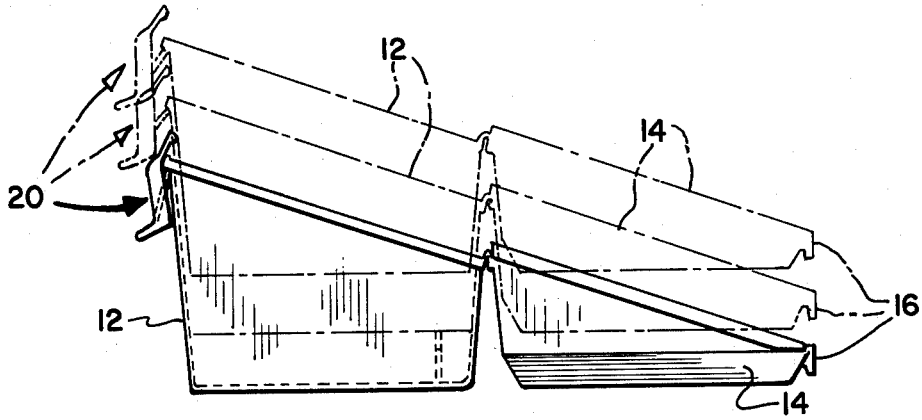
FIG. 7 is a side elevational view of containers and covers in a nested configuration.

By designing the cover and base of the container to have trapezoidal cross-sections as shown in FIGS. 1, 6 and 7 the containers are nestable, one within the other, yielding significant space savings during storage and shipment. As best shown in FIG. 6, in a further embodiment of the invention, the interior of cover 14 has a clip 46 for holding a pencil or the like. Ridges 48 act as easel bases to support documents removed from the container base for viewing. Ridges 50 may also be included along the interior floor of container base 12 to aid in maintaining separate document storage sections within the container. Clip 46 and ridges 48 and 50 may all be integrally molded with the container in the single molding operation described above.

Figure 8:
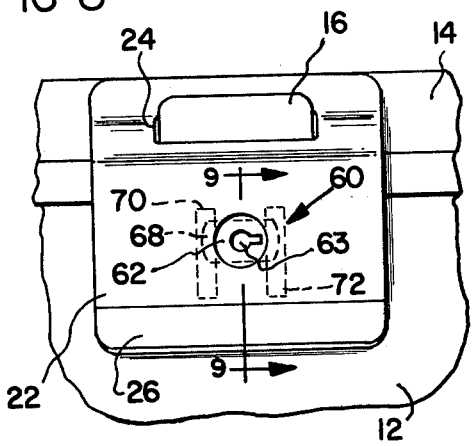
FIG. 8 is a front elevational view of an embodiment of the invention illustrating a locking device in the closure mechanism.
Figure 9:
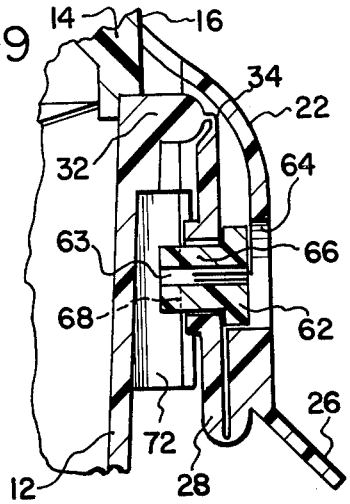
FIG. 9 is a sectional view of the closure mechanism with locking device taken along line 9—9 of FIG. 8.

In a further embodiment of the invention as illustrated in FIGS. 8 and 9, the closure mechanism 20 has a locking device 60 which is operated by a key (not shown). The locking device 60 has a generally cylindrically shaped head portion 62 with a keyhole 63 which is accessible through aperture 64 in the face of first leaf 22. An elongated shaft portion 66 attached to head 62 extends through an opening in second leaf 28 and is held in position by a generally rectangular-shaped locking element 68. When in a locked position as shown in FIG. 8, the locking element 68 engages the edge portions of flanges 70 and 72 which are either integrally molded with or securely attached to the front wall of base 12.

In operation, a key (not shown) is inserted into keyhole 63 in locking device 60 and is turned rotating locking element 68 either into or out of engagement with flanges 70 and 72. When locking element 68 rotated into the position shown in FIG. 8, the closure mechanism is placed in a locked condition. By inserting a key into keyhole 63 and rotating the locking element 90°, the locking element 68 disengages from flanges 70 and 72, and the container can be opened.

While the apparatus herein described constitutes a preferred embodiment of the invention, it is to be understood that the invention is not limited to this precise apparatus, and that changes may be made without departing from the scope of the invention, which is defined in the appended claims.

What is claimed is:

1. A lockable plastic closure mechanism comprising a first leaf including means adapted to engage a protrusion on a container cover, a second leaf connected to said first leaf by a first flexible axially extending web portion of reduced thickness, and a third leaf one edge of which is adapted to be secured to a container wall and the opposite edge of which is connected to said second leaf by a second flexible axially extending web portion of reduced thickness.

2. The lockable plastic closure mechanism of claim 1 in which said engaging means include a longitudinally extending slot across the top edge of said first leaf.

3. The lockable plastic closure mechanism of claim 1 including a means for gripping said first leaf extending outwardly from the lower edge thereof.

4. The lockable plastic closure mechanism of claim 1 in which said second leaf has a length such that it exerts a camming force on said first leaf to lock said mechanism in a closed position when said first leaf is engaging said protrusion and a downward and inward force is applied to said first leaf.

5. A plastic container having a lockable plastic closure mechanism integral therewith comprising a cover having a protrusion along at least one edge thereof and a base having a lockable plastic closure mechanism integral therewith said closure mechanism including a first leaf having means adapted to engage said protrusion on said cover, a second leaf connected to said first leaf by a first flexible axially extending web portion of reduced thickness along one edge of said second leaf, said second leaf being secured to said base by a second flexible axially extending web portion of reduced thickness along the opposite edge of said second leaf.

6. The container of claim 5 including an area of increased cross-section on said base to strengthen and stiffen said container at the point where said second leaf is connected to said base.

7. The container of claim 5 in which said engaging means include a longitudinally extending slot across the top edge of said first leaf.

8. The container of claim 5 including a means for gripping said first leaf extending outwardly from the lower edge thereof.

9. The container of claim 5 in which said second leaf has a length such that it exerts a camming force on said first leaf to lock said closure mechanism in a closed position when said first leaf in engaging said protrusion and a downward and inward force is applied to said first leaf.

10. A plastic container having a lockable plastic closure mechanism integral therewith comprising a cover having a protrusion along at least one edge thereof and a base having a lockable plastic closure mechanism integral therewith said closure mechanism including a first leaf having means adapted to engage said protrusion on said cover, a second leaf connected to said first leaf by a first flexible axially extending web portion of reduced thickness along one edge of said second leaf, said second leaf being secured to said base by a second flexible axially extending web portion of reduced thickness along the opposite edge of said second leaf, the interior of said cover having a clip for holding a writing implement and a series of vertically upstanding ridges for supporting documents for viewing when said container cover is open.

* * * * *